US010217356B2

(12) United States Patent
Baller

(10) Patent No.: US 10,217,356 B2
(45) Date of Patent: Feb. 26, 2019

(54) TIMING SUBMISSION OF TRANSIT SIGNAL PRIORITY REQUESTS TO REDUCE TRANSIT VEHICLE STOP TIMES

(71) Applicant: Global Traffic Technologies, LLC, St. Paul, MN (US)

(72) Inventor: Jonathan Baller, Stillwater, MN (US)

(73) Assignee: Global Traffic Technologies, LLC, St. Paul, MN (US)

( * ) Notice: Subject to any disclaimer, the term of this patent is extended or adjusted under 35 U.S.C. 154(b) by 187 days.

(21) Appl. No.: 15/272,579

(22) Filed: Sep. 22, 2016

(65) Prior Publication Data

US 2018/0082582 A1 Mar. 22, 2018

(51) Int. Cl.
*G08G 1/096* (2006.01)
*G08G 1/087* (2006.01)

(52) U.S. Cl.
CPC ..... *G08G 1/096* (2013.01); *G08G 1/087* (2013.01)

(58) Field of Classification Search
CPC ..... G08G 1/096
See application file for complete search history.

(56) References Cited

U.S. PATENT DOCUMENTS 5,202,683 A 4/1993 Hamer et al.
5,539,398 A 7/1996 Hall et al.
5,926,113 A 7/1999 Jones et al.
5,986,575 A * 11/1999 Jones ..... G08G 1/087 340/906
6,490,519 B1 * 12/2002 Lapidot ..... G01C 21/34 340/905
7,098,806 B2 * 8/2006 Bachelder ..... G08G 1/087 340/906
7,116,245 B1 * 10/2006 Bachelder ..... G08G 1/087 340/906
7,417,560 B2 8/2008 Schwartz
2004/0147291 A1 * 7/2004 Zhang ..... G08G 1/087 455/569.2
2005/0104745 A1 * 5/2005 Bachelder ..... F41G 9/00 340/906

(Continued)

FOREIGN PATENT DOCUMENTS

JP 2010-44527 A 2/2010
JP 2010044527 A * 2/2010 ..... G08G 1/087

OTHER PUBLICATIONS

International Search Report dated Jan. 31, 2018 for corresponding International patent application PCT/US2017/051972.

(Continued)

*Primary Examiner* — Quang Pham
(74) *Attorney, Agent, or Firm* — Crawford Maunu PLLC

(57) ABSTRACT

Approaches are disclosed for timing the submission of transit signal priority (TSP) requests. A phase selector receives TSP information of a vehicle at a current time, and the phase selector determines an estimated time of arrival (ETA) of the vehicle at an intersection having a traffic signal controlled by an intersection controller. The phase selector determines the arrival phase of the traffic signal at the ETA, along with a phase-relative arrival time of the ETA. The phase selector determines a time to issue the TSP request based on the phase-relative arrival time, and issues the TSP request to the intersection controller at the determined time.

30 Claims, 11 Drawing Sheets

(56) References Cited

U.S. PATENT DOCUMENTS

2005/0264431 A1* 12/2005 Bachelder ..... G08G 1/081 340/906
2007/0040700 A1* 2/2007 Bachelder ..... G08G 1/087 340/902
2007/0135990 A1* 6/2007 Seymour ..... G08G 1/01 701/117
2007/0222639 A1* 9/2007 Giles ..... G08G 1/0104 340/907
2008/0059057 A1* 3/2008 Tengler ..... G01C 21/3626 701/465
2009/0189782 A1* 7/2009 Bachelder ..... G08G 1/087 340/906
2011/0084853 A1* 4/2011 Johnson ..... G08G 1/087 340/906
2011/0109477 A1* 5/2011 Edwardson ..... G08G 1/087 340/906
2011/0109478 A1* 5/2011 Williamson ..... G08G 1/087 340/906
2011/0193722 A1* 8/2011 Johnson ..... G08G 1/081 340/906
2011/0234423 A1* 9/2011 Edwardson ..... G08G 1/087 340/906
2011/0304476 A1* 12/2011 Johnson ..... G08G 1/081 340/906
2012/0326890 A1* 12/2012 Cross ..... G08G 1/082 340/906
2015/0243165 A1* 8/2015 Elsheemy ..... B60R 25/00 340/906
2015/0332589 A1* 11/2015 Eichhorst ..... G08G 1/087 340/906
2015/0371538 A1* 12/2015 Eichhorst ..... G08G 1/087 340/906

OTHER PUBLICATIONS

Written Opinion dated Jan. 31, 2018 for corresponding International patent application PCT/US2017/051972.

* cited by examiner

```
602 Receive transit signal priority information from a vehicle

604 Determine adjusted ETA = ETAv + ETAd, compensating for deviation between ETA and ATA

606 Determine amount of time remaining in current phase and set what the next phase will be
If time to green is greater than time to non-green
        TotalPhases = time-to-non-green
        NextPhase  = NON-GREEN
Else (time to green is less than time to non-green)
        Total Phases = time-to-green
        NextPhase = GREEN

608 Total the amount of time until the first phase change after the adjusted ETA, and determine what the phase
will be at that time
While (TotalPhases <= adjusted ETA)
        If NextPhase == GREEN
                TotalPhases += GP
                NextPhase == NON-GREEN
        Else (NextPhase is non-green)
                TotalPhases += NGP
                NextPhase == GREEN

610 Determine whether non-green truncation or green extension and the time when the truncation or extension
is desired
TEphase = TotalPhases – adjusted ETA (phase relative arrival time: when in the phase the vehicle is expected
to arrive )
If NextPhase == NON-GREEN (arrival phase expected to be green)
        LocPhase = TEphase / GP (in phase ratio:  1 => at beginning, 0=> at end )
        If LocPhase > Non-green truncation threshold (vehicle to arrive near beginning of green phase)
                T_TSP_desired = TotalPhases – GP (set the time for TSP request, truncate previous)
                TSPTreatment = Non-green truncation
        Else (vehicle to arrive later in green phase, so green extension)
                T_TSP_desired = TotalPhases (set the time for TSP request to end of green phase)
                TSPTreatment = Green extension
Else (arrival phase expected to be non-green)
        LocPhase = TEphase / NGP (in phase ratio:  1 => at beginning, 0=> at end )
        If LocPhase > Green extension threshold (vehicle to arrive near beginning of non-green phase)
                T_TSP_desired = TotalPhases – NGP (set the time for TSP request, extend previous green)
                TSPTreatment = Green extension
        Else (vehicle to arrive later in non-green phase, so truncate non-green)
                T_TSP_desired = TotalPhases (set the time for TSP request to end of green phase)
                TSPTreatment = Non-green truncation

612 Determine the time the TSP request should be made to the intersection controller
If TSPTreatment == Non-green truncation
        Time_to_issue = T_TSP_desired – Win_to_TSP_RT (subtract time to allow processing of TSP request)
Else
        Time_to_issue = T_TSP_desired – Win_to_TSP_GE
```

FIG. 14

TIMING SUBMISSION OF TRANSIT SIGNAL PRIORITY REQUESTS TO REDUCE TRANSIT VEHICLE STOP TIMES

FIELD OF THE INVENTION

The disclosure generally describes methods and systems for timing the submission of transit signal priority requests for controlling traffic signals.

BACKGROUND

Traffic signals have long been used to regulate the flow of traffic at intersections. Generally, traffic signals have relied on timers or vehicle sensors to determine when to change traffic signal lights, thereby signaling alternating directions of traffic to stop, and others to proceed.

Emergency vehicles, such as police cars, fire trucks and ambulances, generally have the right to cross an intersection against a traffic signal. Emergency vehicles have in the past typically depended on horns, sirens and flashing lights to alert other drivers approaching the intersection that an emergency vehicle intends to cross the intersection. However, due to hearing impairment, air conditioning, audio systems and other distractions, often the driver of a vehicle approaching an intersection will not be aware of a warning being emitted by an approaching emergency vehicle.

Traffic control preemption systems assist authorized vehicles (police, fire and other public safety or transit vehicles) through signalized intersections by making preemption requests to the intersection controllers that control the traffic lights at the intersections. The intersection controller may respond to the preemption request from the vehicle by changing the intersection lights to green in the direction of travel of the approaching vehicle. This system improves the response time of public safety personnel, while reducing dangerous situations at intersections when an emergency vehicle is trying to cross on a red light. In addition, speed and schedule efficiency can be improved for transit vehicles.

There are presently a number of known traffic control preemption systems that have equipment installed at certain traffic signals and on authorized vehicles. One such system in use today is the OPTICOM® system. This system utilizes a high power strobe tube (emitter), which is located in or on the vehicle and generates light pulses at a predetermined rate, typically 10 Hz or 14 Hz. A receiver, which includes a photodetector and associated electronics, is typically mounted on the mast arm located at the intersection and produces a series of voltage pulses, the number of which are proportional to the intensity of light pulses received from the emitter. The emitter generates sufficient radiant power to be detected from over 2500 feet away. The conventional strobe tube emitter generates broad spectrum light. However, an optical filter is used on the detector to restrict its sensitivity to light only in the near infrared (IR) spectrum. This minimizes interference from other sources of light.

Intensity levels are associated with each intersection approach to determine when a detected vehicle is within range of the intersection. Vehicles with valid security codes and a sufficient intensity level are reviewed with other detected vehicles to determine the highest priority vehicle. Vehicles of equivalent priority are selected in a first come, first served manner. A preemption request is issued to the controller for the approach direction with the highest priority vehicle travelling on it.

Another common system in use today is the OPTICOM GPS priority control system. This system utilizes a GPS receiver in the vehicle to determine location, speed and heading of the vehicle. The information is combined with security coding information that consists of an agency identifier, vehicle class, and vehicle ID, and is broadcast via a proprietary 2.4 GHz radio.

An equivalent 2.4 GHz radio located at the intersection along with associated electronics receives the broadcasted vehicle information. Approaches to the intersection are mapped using either collected GPS readings from a vehicle traversing the approaches or using location information taken from a map database. The vehicle location and direction are used to determine on which of the mapped approaches the vehicle is approaching toward the intersection and the relative proximity to it. The speed and location of the vehicle are used to determine the estimated time of arrival (ETA) at the intersection and the travel distance from the intersection. ETA and travel distances are associated with each intersection approach to determine when a detected vehicle is within range of the intersection and therefore a preemption candidate. Preemption candidates with valid security codes are reviewed with other detected vehicles to determine the highest priority vehicle. Vehicles of equivalent priority are selected in a first come, first served manner. A preemption request is issued to the controller for the approach direction with the highest priority vehicle travelling on it.

With metropolitan wide networks becoming more prevalent, additional means for detecting vehicles via wired networks, such as Ethernet or fiber optics, and wireless networks, such as cellular, Mesh or 802.11b/g, may be available. With network connectivity to the intersection, vehicle tracking information may be delivered over a network medium. In this instance, the vehicle location is either broadcast by the vehicle itself over the network or it may be broadcast by an intermediary gateway on the network that bridges between, for example, a wireless medium used by the vehicle and a wired network on which the intersection electronics reside. In this case, the vehicle or an intermediary reports, via the network, the vehicle's security information, location, speed and heading along with the current time on the vehicle, intersections on the network receive the vehicle information and evaluate the position using approach maps as described in the Opticom GPS system. The security coding could be identical to the Opticom GPS system or employ another coding scheme.

SUMMARY

In a disclosed method of submitting transit signal priority (TSP) requests, a phase selector receives TSP information of a vehicle at a current time. The phase selector determines from the TSP information, an estimated time of arrival (ETA) of the vehicle at an intersection having a traffic signal controlled by an intersection controller. The phase selector further determines an arrival phase of the traffic signal at the ETA and a phase-relative arrival time of the ETA in the arrival phase. The phase selector determines a time to issue the TSP request based on the phase-relative arrival time, and issues the TSP request to the intersection controller at the determined time.

In a disclosed traffic signal control system, a phase selector is configured and arranged to receive TSP information of a vehicle at a current time and to determine from the TSP information, an estimated time of arrival (ETA) of the vehicle at an intersection having the traffic signal. The phase selector is further configured and arranged to determine an arrival phase of the traffic signal at the ETA and to determine a phase-relative arrival time of the ETA in the arrival phase. The phase selector is also configured and arranged to determine a time to issue the TSP request based on the phase-relative arrival time and output the TSP request at the determined time. The traffic signal control system further includes an intersection controller coupled to the phase selector and to the traffic light, the intersection controller is configured and arranged to adjust a phase of the traffic signal in response to the TSP request.

Other embodiments will be recognized from consideration of the Detailed Description and Claims, which follow.

BRIEF DESCRIPTION OF THE DRAWINGS

Various aspects and advantages of the disclosed embodiments will become apparent upon review of the following detailed description and upon reference to the drawings in which:

FIG. 14 shows a process of determining the time to issue a TSP request;

DETAILED DESCRIPTION OF THE DRAWINGS

Figure 1:
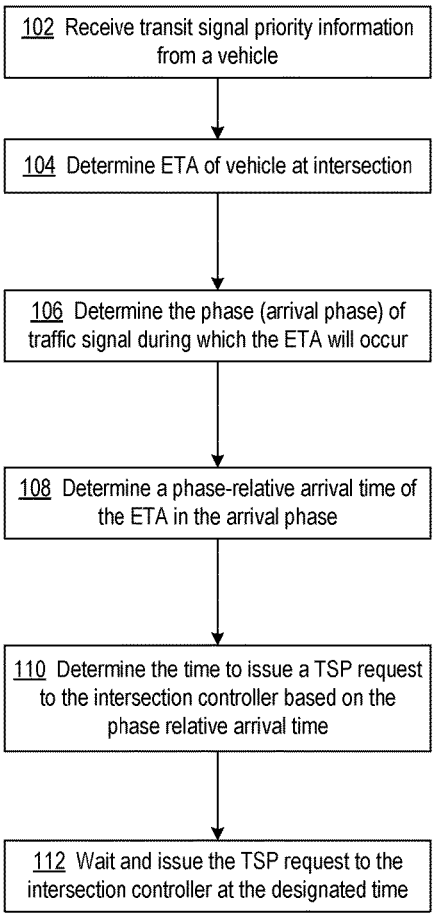
FIG. 1 shows a flowchart of a process of determining a suitable time to submit and then waiting to submit a transit signal priority (TSP) request.

In the following description, numerous specific details are set forth to describe specific examples presented herein. It should be apparent, however, to one skilled in the art, that one or more other examples and/or variations of these examples may be practiced without all the specific details given below. In other instances, well known features have not been described in detail so as not to obscure the description of the examples herein. For ease of illustration, the same reference numerals may be used in different diagrams to refer to the same elements or additional instances of the same element.

Equipment for controlling traffic signals at an intersection generally includes an intersection controller that cycles through the green, yellow, and red phases of a traffic light and a phase selector that receives identification and tracking information from vehicles. The phase selector determines when to submit a transit signal priority (TSP) request to the controller based on the ETA and/or distance between the transit vehicle and the intersection. In response to a TSP request the intersection controller can deviate from timed phases and extend the duration of a green phase or truncate the duration of a red phase in order to reduce or eliminate the stop time at the intersection for a transit vehicle.

Using only the ETA and/or distance of a transit vehicle from the intersection to control when a TSP request is issued to the intersection controller can sometimes be detrimental to the objective of reducing congestion. In current systems, when the information received from a vehicle meets the ETA/distance threshold for the phase selector to issue a TSP request, the phase selector issues the TSP request without regard to the current phase or duration of the phases of the traffic signal. In some cases, the transit vehicle may not benefit from the TSP request, and the TSP request can unnecessarily delay cross traffic. For example, if the vehicle ETA/distance qualifies for TSP, and the next green phase is extended for the vehicle, but based on the ETA the transit vehicle would arrive at the intersection after the extended green phase, then the transit vehicle will not benefit from the extended green phase and cross traffic will be unnecessarily delayed.

The disclosed systems and methods attempt to make TSP requests at times that would be most effective in reducing or eliminating the stop time of a transit vehicle at an intersection. The systems and methods consider not only the ETA/distance of a vehicle from an intersection in determining when to issue a TSP request, but also expected durations of the phases of the traffic signal. For example, if a vehicle's ETA/distance qualifies for TSP and the ETA is beyond the end of the next green phase, the phase selector can delay the TSP request to allow the vehicle to benefit from a truncation of a subsequent red phase or an extension of subsequent green phase.

FIG. 1 shows a flowchart of a process of determining a suitable time to submit and then waiting to submit a transit signal priority (TSP) request. In one implementation, the timing of submission of a TSP request is made to affect either the signal phase in which the vehicle is expected to arrive (the "arrival phase") or the signal phase immediately prior to the signal phase in which the vehicle is excepted to arrive (the "previous phase"). If the ETA is sufficiently early in a green phase, then the previous phase is a red phase, and a TSP request is made to truncate the previous red phase. The combination of a yellow phase and a red phase is referred to as a non-green phase. If the ETA is sufficiently later in a green phase, then a TSP request is made to extend the arrival green phase. If the ETA is sufficiently early in a non-green phase, then a TSP request is made to extend the previous green phase. If the ETA is sufficiently later in a non-green phase, then a TSP request is made to truncate the arrival non-green phase.

At block 102, the phase selector receives TSP information of a vehicle, and at block 104, the phase selector determines the ETA of the vehicle. The TSP information can vary from one implementation to another. In one implementation, the TSP information specifies an identifier, location, heading, and speed of the vehicle. In another implementation, the TSP information can include the ETA as calculated by a module aboard the transit vehicle or by a phase selector situated at an intersection or at a centralized traffic management system. The ETA can be determined by reading the ETA from the TSP information or by computing the ETA based on the location, heading, and speed of the vehicle relative to the location of the intersection. The phase selector can further refine the ETA by adjusting the ETA to compensate for trends in the calculated ETAs versus actual times of arrival (ATAs). If the ATAs are on average later than the ETAs, some amount of time can be added to an initial ETA to produce an adjusted ETA. If the ATAs are on average earlier than the ETAs, some amount of time can be subtracted from the initial ETA. The phase selector as used herein refers to implementations in which equipment is situated at intersections for initiating TSP requests as well to implementations in which a centralized traffic management system initiates TSP requests to intersection controllers.

At block 106, the phase selector determines the signal phase in which the vehicle is expected to arrive at the intersection, which is referred to as the "arrival phase," and at block 108 determines the phase relative time the vehicle is expected to arrive. In determining the signal phase in which the vehicle is expected to arrive at the intersection, the phase selector determines the time remaining in the current phase and uses the average lengths of green and non-green phases to determine the arrival phase and the phase relative time. The phase relative time is the offset from the beginning of the arrival phase of the adjusted ETA.

The phase selector determines the time to issue the TSP request to the intersection controller at block 110. The adjusted ETA, arrival phase, phase relative arrival time, and thresholds relative to the beginnings of the green and non-green phases are used to determine the time to issue the TSP request. The time to issue the TSP request can be specified as an offset from the time at which the TSP information was received, and a timer can be used to track time elapsed from the time that the phase selector determines that the vehicle is on the approach to the intersection and will be granted TSP.

If the arrival phase is a green phase and the adjusted ETA is before a non-green truncation threshold, the determined time to issue the TSP request is the time at which submitting the TSP request to the intersection controller would cause the intersection controller to truncate the previous non-green phase. If the adjusted ETA is after the non-green truncation threshold, the determined time to issue the TSP request is the time at which submitting the TSP request to the intersection controller would cause the intersection controller to extend the arrival green phase.

If the arrival phase is a non-green phase and the adjusted ETA is before a green extension threshold, the determined time to issue to the TSP request is the time at which submitting the TSP request to the intersection controller would cause the intersection controller to extend the previous green phase. If the adjusted ETA is after the green extension threshold, the determined time to issue to the TSP request is the time at which submitting the TSP request to the intersection controller would cause the intersection controller to truncate the arrival non-green phase.

At block 112, the phase selector waits and issues the TSP request at the time determined at block 110.

Figure 2:
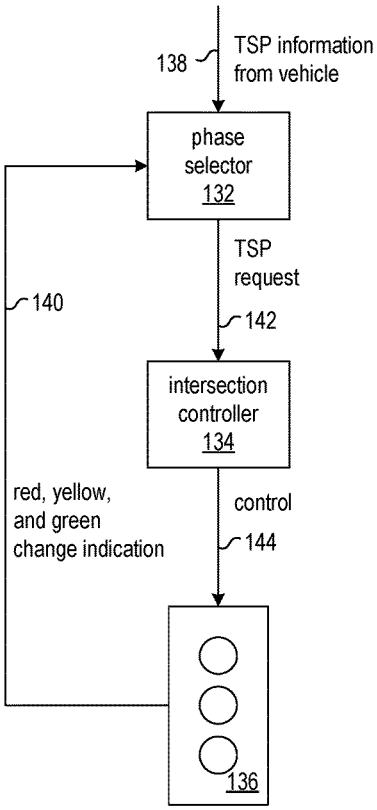
FIG. 2 shows a traffic signal control arrangement having a phase selector that determines a suitable time to submit a TSP request.

FIG. 2 shows a traffic signal control arrangement having a phase selector that determines a suitable time to submit a TSP request. The traffic signal control arrangement includes phase selector 132, intersection controller 134, and traffic signal 136. Further description of implementations of the intersection controller and phase selector, may be found in U.S. Pat. Nos. 5,202,683, 5,539,398, 5,926,113, 7,417,560, which are incorporated herein by reference, each in its entirety.

The phase selector inputs TSP information for vehicles on signal line 138 and inputs signals indicative of phase changes on signal line 140. The TSP information can be received directly from vehicles such as by radio or IR light signals or received indirectly from a centralized traffic management computer system.

The phase selector monitors the traffic signal for purposes of gathering data used to determine the arrival phase, phase relative offset, and average lengths of green and non-green phases, among other data. In one implementation, the phase selector monitors green phases through a connection to the electrical wires that power the green light and senses when the green light is powered on and off. In another implementation, the phase selector can acquire phase information directly from the intersection controller. However, many intersection controllers are not readily accessible or do not provide phase information. In implementations in which the phase selector is part of a centralized traffic management system, the signal phase transitions are detected at the intersection and transmitted to the centralized traffic management system such as through a wireless or wired network.

The phase selector 132 outputs TSP requests to the intersection controller 134 on signal line 142 at times determined according to the processes described herein. In response to a TSP request, the intersection controller either extends a green phase or truncates a red phase of the traffic light 136 by way of control signals transmitted on line 144.

Figure 3:
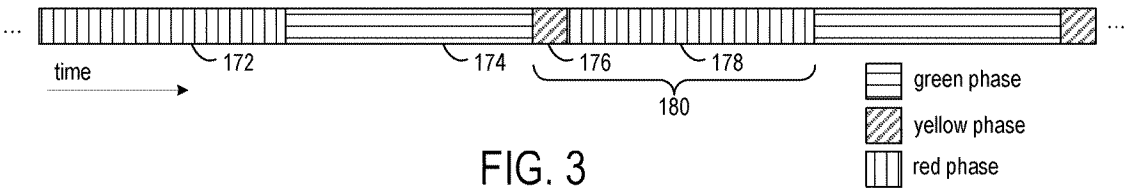
FIG. 3 illustrates phases of a traffic signal over a period of time.

FIG. 3 illustrates phases of a traffic signal over a period of time. Each red phase, such as phase 172, is represented by a block having vertical hash lines, each green phase, such as phase 174, is represented by a block having horizontal hash lines, and each yellow phase, such as phase 176, is represented by a block having diagonal hash lines. A yellow phase and the following red phase are referred to as a non-green phase. For example, yellow phase 176 and red phase 178 constitute non-green phase 180.

Figure 4:
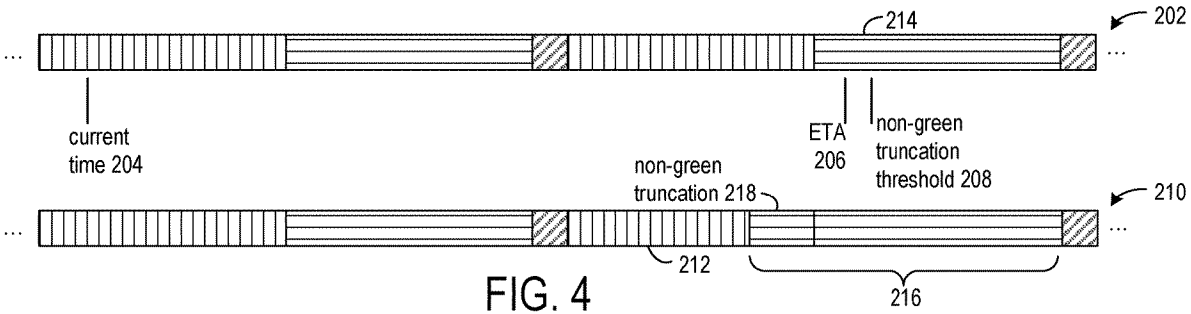
FIG. 4 illustrates a scenario in which the ETA of a vehicle is in a green phase, the ETA precedes a non-green truncation threshold, and the preceding non-green phase is truncated.

FIGS. 4, 5, 6, and 7 show scenarios in which the phase selector determines suitable times to submit TSP requests according to the traffic signal phase and the time in the traffic signal phase at which the transit vehicle is expected to arrive. The figures also show the resulting non-green truncation or green extension. FIG. 4 illustrates a scenario in which the ETA of a vehicle is in a green phase, the ETA precedes a non-green truncation threshold, and the preceding non-green phase is truncated. Phases 202 include a sequence of traffic signal phases and shows a current time 204 at which TSP information is received, the ETA 206 of the vehicle, and a non-green truncation threshold 208. Phases 210 show the result of waiting and issuing the TSP request at the determined time. Phases 210 include a sequence of traffic signal phases in which the previous non-green phase 212 is truncated based on the ETA relative to the non-green truncation threshold.

In response to receiving TSP information at current time 204, the phase selector determines the ETA 206. As the ETA is determined to be in a green phase 214 and the phase-relative ETA is before the non-green truncation threshold, the phase selector determines that the previous non-green phase can be truncated. By truncating the previous non-green phase, the duration of the green phase 214 is increased to green phase 216, and the stop time for the transit vehicle can be reduced or eliminated. The increase in the green phase is shown as the non-green truncation 218. The non-green truncation threshold is a configurable value that marks a time in the green phase at which a transit vehicle having an earlier ETA would likely benefit from a truncation of the previous non-green phase. A transit vehicle having an ETA later than the non-green truncation threshold would not likely benefit from truncating the previous non-green phase.

The non-green truncation threshold is set to a value that improves the probability that the truncation will benefit the requesting vehicle. The non-green truncation threshold is used because ETAs are not precise. If ETAs were precise, a TSP request could be submitted for achieving a non-green truncation when the ETA is within a non-green phase and outside a green extension of the preceding green phase. In other words, if the phase will be non-green when the vehicle arrives, request the intersection controller to transition to the green phase earlier. Although the vehicle may have to stop, the duration of the stop will be less than without the truncation.

Varying conditions will affect ETAs, and the standard deviation of the ETAs to ATAs can be used to tailor the non-green truncation threshold. A greater standard deviation implies that the ETAs are less certain and a larger time buffer is desirable. A lower standard deviation implies ETAs are more precise and that the use of TSP can be optimized. In some implementations, the non-green truncation threshold is configurable such as by a system administrator. The default value can be the end of the green phase plus the amount of time for a green extension time. If the standard deviation is high, the non-green truncation threshold may be set to the end of the green phase.

Figure 5:
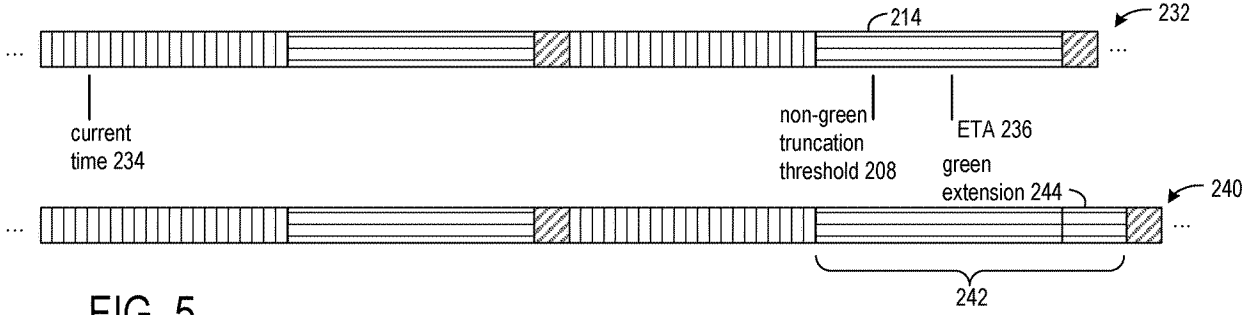
FIG. 5 shows a scenario in which the ETA of a vehicle is in a green phase, the ETA is after a non-green truncation threshold, and the arrival green phase is extended.

FIG. 5 shows a scenario in which the ETA of a vehicle is in a green phase, the ETA is after a non-green truncation threshold, and the arrival green phase is extended. Phases 232 include a sequence of traffic signal phases and shows a current time 234 at which TSP information is received, the ETA 236 of the vehicle, and the non-green truncation threshold 208. Phases 240 include a sequence of traffic signal phases in which the arrival green phase 242 is extended based on the ETA relative to the non-green truncation threshold.

In response to receiving TSP information at current time 234, the phase selector determines the ETA 236. As the ETA is determined to be in a green phase 214 and the phase-relative ETA is after the non-green truncation threshold, the phase selector determines that the arrival green phase can be extended. By extending the arrival green phase, the duration of the green phase 214 is increased to green phase 242, and the probability of the vehicle transiting the intersection before the beginning of the non-green phase is increased. The increase in the green phase is shown as the green extension 244. The non-green truncation threshold is a configurable value that marks a time in the green phase that a transit vehicle having a later ETA would likely benefit from extension of the arrival green phase. A transit vehicle having an ETA earlier than the non-green truncation threshold would not likely benefit from extending the arrival green phase.

Figure 6:
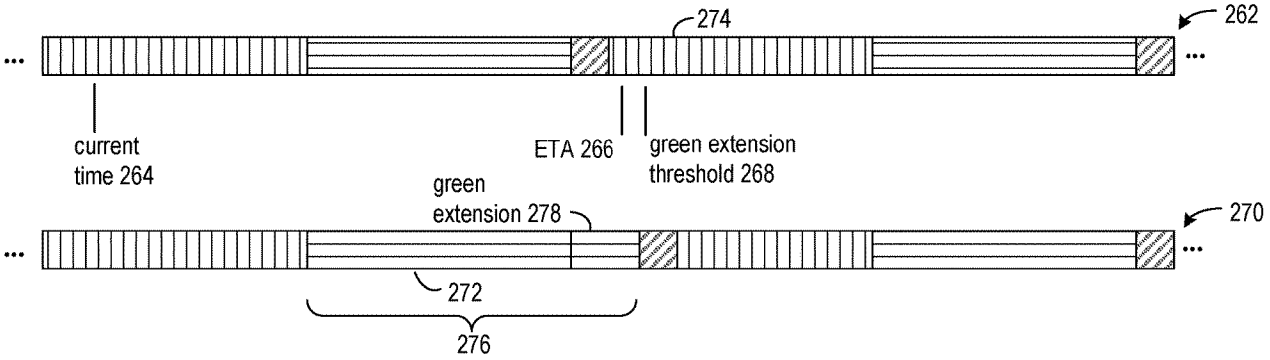
FIG. 6 shows a scenario in which the ETA of a vehicle is in a non-green phase, and the ETA is before a green extension threshold, and the preceding green phase is extended.

FIG. 6 shows a scenario in which the ETA of a vehicle is in a non-green phase, and the ETA is before a green extension threshold, and the preceding green phase is extended. Phases 262 include a sequence of traffic signal phases and shows a current time 264 at which TSP information is received, the ETA 266 of the vehicle, and the green extension threshold 268. Phases 270 include a sequence of traffic signal phases in which the previous green phase 272 is extended based on the ETA relative to the green extension threshold.

In response to receiving TSP information at current time 264, the phase selector determines the ETA 266. As the ETA is determined to be in a non-green phase 274 and the phase-relative ETA is before the green extension threshold, the phase selector determines that the previous green phase can be extended. By extending the previous green phase, the duration of the green phase 272 is increased to green phase 276, and the probability of the vehicle transiting the intersection before the beginning of the non-green phase is increased. The increase in the green phase is shown as the green extension 278. The green extension threshold is a configurable value that marks a time in the non-green phase that a transit vehicle having an earlier ETA would likely benefit from extension of the previous green phase. A transit vehicle having an ETA earlier than the green extension threshold would not likely benefit from extending the previous green phase.

The green extension truncation threshold is set to a value that improves the probability that the extension will benefit the requesting vehicle. The green extension threshold is used because ETAs are not precise. If ETAs were precise, a TSP request could be submitted for achieving a green extension when the ETA is at the end of or just after the end of a green phase.

In some implementations, the green extension threshold is configurable such as by a system administrator. The default value can be the end of the green phase. If the standard deviation is high, the green extension threshold can be set to the middle of the green phase.

Figure 7:
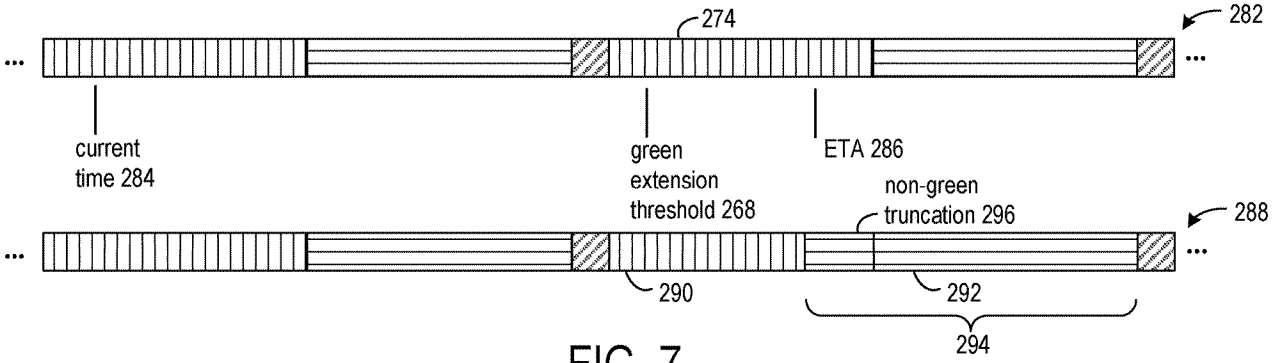
FIG. 7 shows a scenario in which the ETA of a vehicle is in a non-green phase, and the ETA is after a green extension threshold, and the non-green phase is truncated.

FIG. 7 shows a scenario in which the ETA of a vehicle is in a non-green phase, and the ETA is after a green extension threshold, and the non-green phase is truncated. Phases 282 include a sequence of traffic signal phases and shows a current time 284 at which TSP information is received, the ETA 286 of the vehicle, and the green extension threshold 268. Phases 288 include a sequence of traffic signal phases in which the arrival non-green phase 290 is truncated based on the ETA relative to the green extension threshold.

In response to receiving TSP information at current time 284, the phase selector determines the ETA 286. As the ETA is determined to be in the non-green phase 274 and the phase-relative ETA is after the green extension threshold 268, the phase selector determines that the arrival non-green phase can be truncated. By truncating the arrival non-green phase, the duration of the green phase 292 is increased to green phase 294, and the stop time for the transit vehicle is reduced or eliminated. The increase in the green phase is shown as the non-green truncation 296. The green extension threshold is a configurable value that marks a time in the non-green phase that a transit vehicle having a later ETA would likely benefit from truncation of the arrival non-green phase. A transit vehicle having an ETA earlier than the green extension threshold would not likely benefit from truncating the arrival non-green phase.

Some scenarios may call for no TSP requests to be made. That is, in some situations issuing a TSP request would unlikely have a positive effect. A no-TSP window can be used to suppress certain TSP requests. For example, the no-TSP window can have one boundary at one standard deviation after the beginning of a green phase and the other boundary one standard deviation before the end of the green phase. If the ETA falls within the no-TSP window, no TSP request is made.

In determining the time to submit a TSP request, the phase selector accounts for the behavior of the intersection controller in granting a non-green truncation or a green extension. There is a certain period of time in which a TSP request must be submitted to the intersection controller in order for the intersection controller to extend a particular a green phase. This period of time may be referred to as the "green extension window." Similarly, there is a certain period of time in which a TSP request must be submitted to the intersection controller in order for the intersection controller to truncate a particular a non-green phase. This period of time may be referred to as the "non-green truncation window." There also may be a window in which are made and no TSP treatment is given. Such a window is a "No-TSP treatment-Given window."

Figure 8:
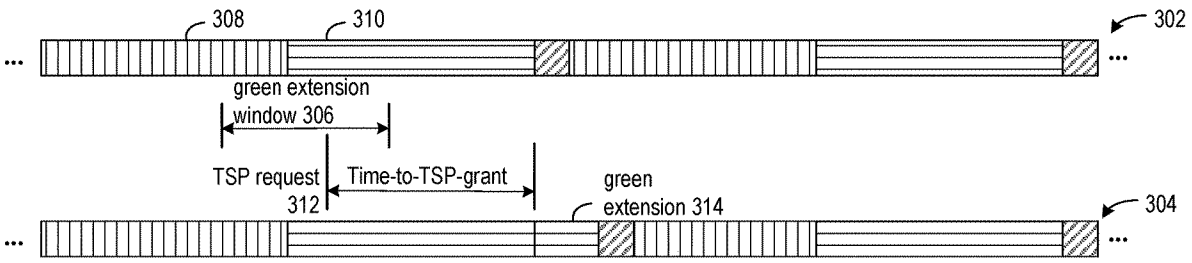
FIG. 8 shows a scenario in which a TSP request made within the green extension window results in a green extension.

FIG. 8 shows a scenario in which a TSP request made within the green extension window results in a green extension. Phases 302 show uninterrupted phases of a traffic signal, and phases 304 show an extension of a green phase of the traffic signal. The green extension window 306 spans parts of non-green phase 308 and green phase 310. If a TSP request 312 is made within the green extension window, the intersection controller will extend green phase 310 by green extension 314. The length of time between the time at which the TSP request 312 was made and the time at which the TSP was granted can be referred to as the Time-to-TSP-grant. The time of grant for a green extension is at the end of the green phase and beginning of the extension. The phase selector averages the Time-to-TSP-grant for green extensions, and the average is used in computing the time at which a TSP request is made to the intersection controller to cause a green extension.

Figure 9:
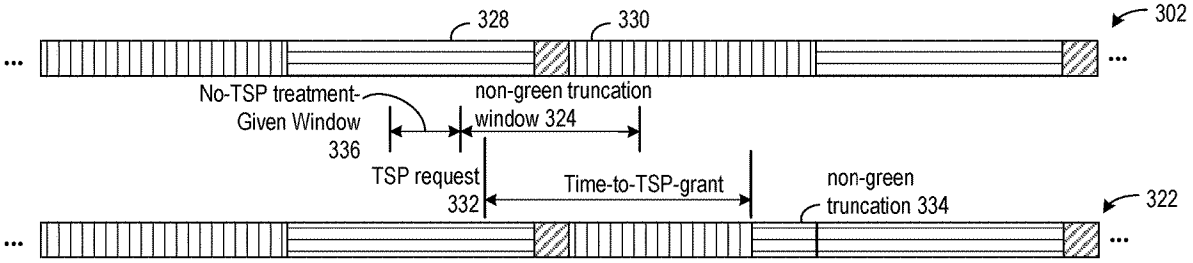
FIG. 9 shows a scenario in which a TSP request made within the non-green truncation window results in a non-green truncation.

FIG. 9 shows a scenario in which a TSP request made within the non-green truncation window results in a non-green truncation. Phases 302 show uninterrupted phases of a traffic signal, and phases 322 show a truncation of a non-green phase of the traffic signal. The non-green truncation window 324 spans parts of green phase 328 and non-green phase 330. If a TSP request 332 is made to the intersection controller within the non-green truncation window, the intersection controller truncates non-green phase 330 by non-green truncation extension 334. The time of grant for a non-green truncation is at the beginning of the truncation at which the signal turns green. The phase selector averages the Time-to-TSP-grant for non-green truncation, and the average is used in computing the time at which a TSP request is made to the intersection controller to cause a non-green truncation.

The No-TSP treatment-Given window 336 covers a portion of the green phase 328 between the green extension window 306 (FIG. 8) and the non-green truncation window 324.

Along with the averages of the Time-to-TSP-grant for green extensions and non-green truncations, the phase selector uses average lengths of green and non-green phases to determine the appropriate time to issue TSP requests. In accumulating data points for calculating the average lengths of green and non-green phases, the phase selector distinguishes between green phases that have been extended and green phases that have not been extended, and distinguishes between non-green phases that have been truncated and non-green phases that have not been truncated. The phase selector also uses timers that track how much time has lapsed in the current phase, which indicate the amount of time remaining in a phase when TSP information is received.

Figure 10:
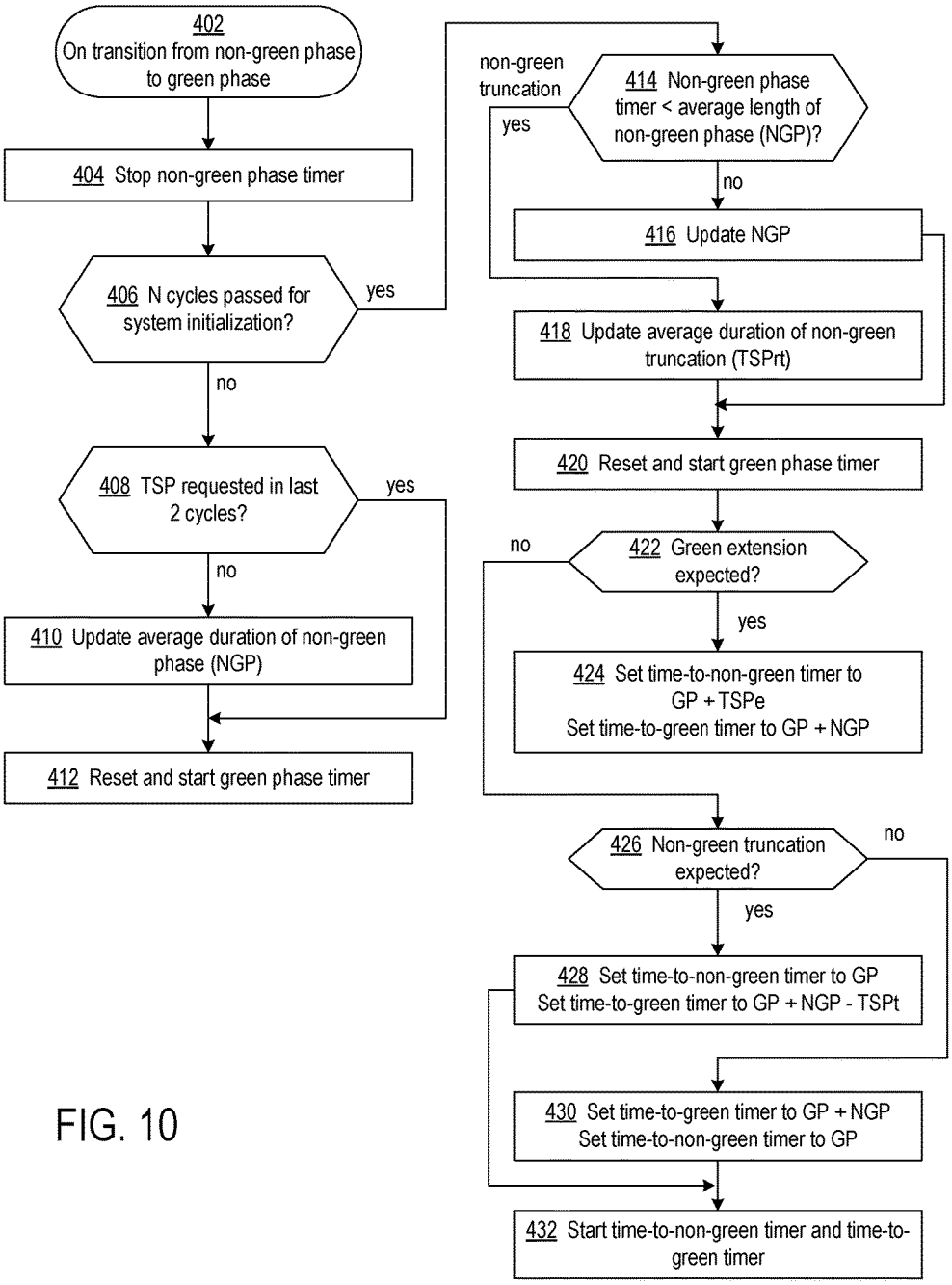
FIG. 10 shows a process of establishing and tracking the average length of a non-green phase and establishing and tracking the average length of a non-green truncation.

FIG. 10 shows a process of establishing and tracking the average length of a non-green phase and establishing and tracking the average length of a non-green truncation. There may be external influences that affect the duration of a phase such as vehicle detection, time of day, pedestrian crossings and other factors, which is the reason for averaging the lengths over time. The phase selector uses a green phase timer and a non-green phase timer to track the duration of each green phase and each non-green phase. On a transition 402 from a non-green phase to a green phase, the phase selector stops the non-green phase timer at block 404.

A truncated non-green phase is shorter than a standard non-green phase. However, the phase selector does not initially have the value of the standard non-green phase. The phase selector in blocks 406-412 performs an initial averaging to establish a baseline average of non-green phases. The initial averaging will be done before the averages are used in calculating the request times.

At decision block 406, the phase selector determines whether or not N cycles of green-to-non-green phases have occurred for purpose of initialization. A sample size of 10 should be sufficient for most applications. If not, the process proceeds to decision block 408 to determine whether or not a TSP request was made in the previous two cycles of green-to-non-green phases. If not, the average duration of the non-green phases (NGP) is updated at block 410 with the value of the non-green phase timer. Otherwise, at block 412, the phase selector resets and starts the green phase timer.

Once the initial N cycles of green-to-non-green phases have occurred, the phase selector continues processing at decision block 414. At decision block 414, the phase selector determines whether the phase that just ended had a non-green truncation by comparing the non-green phase timer to the average length of the non-green phase. If the non-green phase was not truncated, at block 416, the phase selector updates the average length of non-green phases (NGP). Otherwise, at block 418 the phase selector updates the average length of a non-green truncation (TSPrt). After blocks 416 and 418, the phase selector proceeds to block 420.

At block 420, the phase selector resets and starts the green phase timer. At decision block 422, the phases selector checks whether a green extension is expected. A green extension can be expected if the phase selector submitted a TSP request within the green extension window with the desired treatment by the intersection controller being a green extension. If a green extension is expected, the phase selector proceeds to block 424.

A time-to-non-green timer is used to track the time remaining in the current green phase, and a time-to-green timer is used to track the time remaining until the next green phase. At block 424, the time-to-non-green timer is set to the average length of green phases (GP) plus the average length of green extensions (TSPe) (time-to-non-green=GP+TSPe), and the time-to-green timer is set to GP plus the average length of non-green phases (NGP) (time-to-green=GP+NGP). The time-to-green timer does not include the TPSe, because the subsequent non-green phase will be shortened due to the green extension.

If a green extension is not expected, the phase selector proceeds to decision block 426. At decision block 426, the phases selector checks whether a non-green truncation is expected. A non-green truncation can be expected if the phase selector submitted a TSP request within the non-green truncation window with the desired treatment by the intersection controller being a non-green truncation. If a non-green truncation extension is expected, the phase selector proceeds to block 428. At block 428, the time-to-non-green timer is set to the average length of green phases (GP) (time-to-non-green=GP), and the time-to-green timer is set to GP plus the average length of non-green phases (NGP) less the average length of non-green truncations (TSPt) (time-to-green=GP+NGP−TSPt).

If neither a green extension nor a non-green truncation are expected, at block 430, the phase selector sets the time-to-green timer to GP+NGP and sets the time-to-non-green timer to GP. At block 432, the phase selector starts the time-to-green and time-to-non-green timers.

Figure 11:
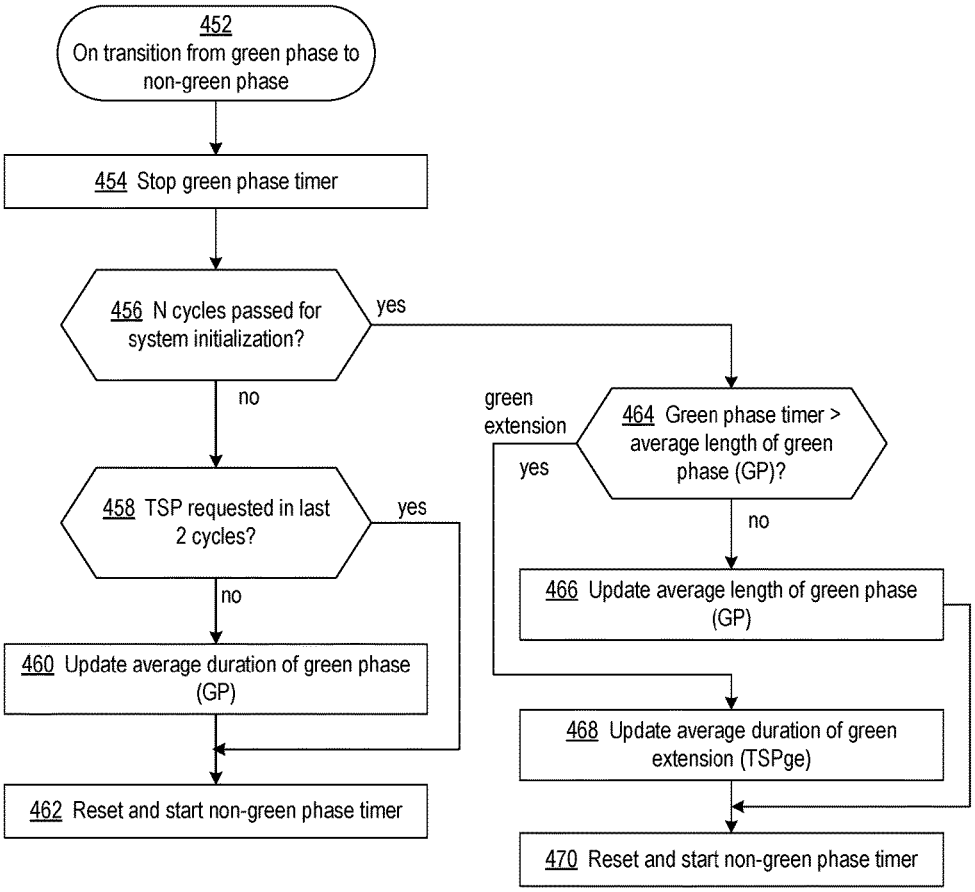
FIG. 11 shows a process performed by the phase selector in transitioning from a green phase to a non-green phase, updating the average length of a green phase and controlling the green phase and the non-green phase timers.

FIG. 11 shows a process performed by the phase selector in transitioning from a green phase to a non-green phase, updating the average length of a green phase and controlling the green phase and the non-green phase timers. At block 454, the phase selector stops the green phase timer.

At decision block 456, the phase selector determines whether or not N cycles of green-to-non-green phases have occurred for purpose of initialization. A sample size of 10 should be sufficient for most applications. If not, the process proceeds to decision block 458 to determine whether or not a TSP request was made in the previous two cycles of green-to-non-green phases. If not, the average duration of the green phases (GP) is updated at block 460 with the value of the green phase timer. Otherwise, at block 462, the phase selector resets and starts the non-green phase timer.

Once the initial N cycles of green-to-non-green phases have occurred, the phase selector continues processing at decision block 464. The phase selector determines at decision block 464 whether or not the just-completed green phase was extended by comparing the value of the green phase timer to the average length of green phases (GP). If the value of the green phase timer is greater than average length of green phases (GP), a green extension has occurred, and the phase selector proceeds to block 466 where the average length of the green extension (TSPe) is updated. If a green extension did not occur, at block 468 the phase selector updates the average length of the green phase (GP). The averages can be cumulative or moving averages and can be a mean, median, or mode of the collected data values. At block 470, the phase selector resets and restarts the non-green phase timer.

Figure 12:
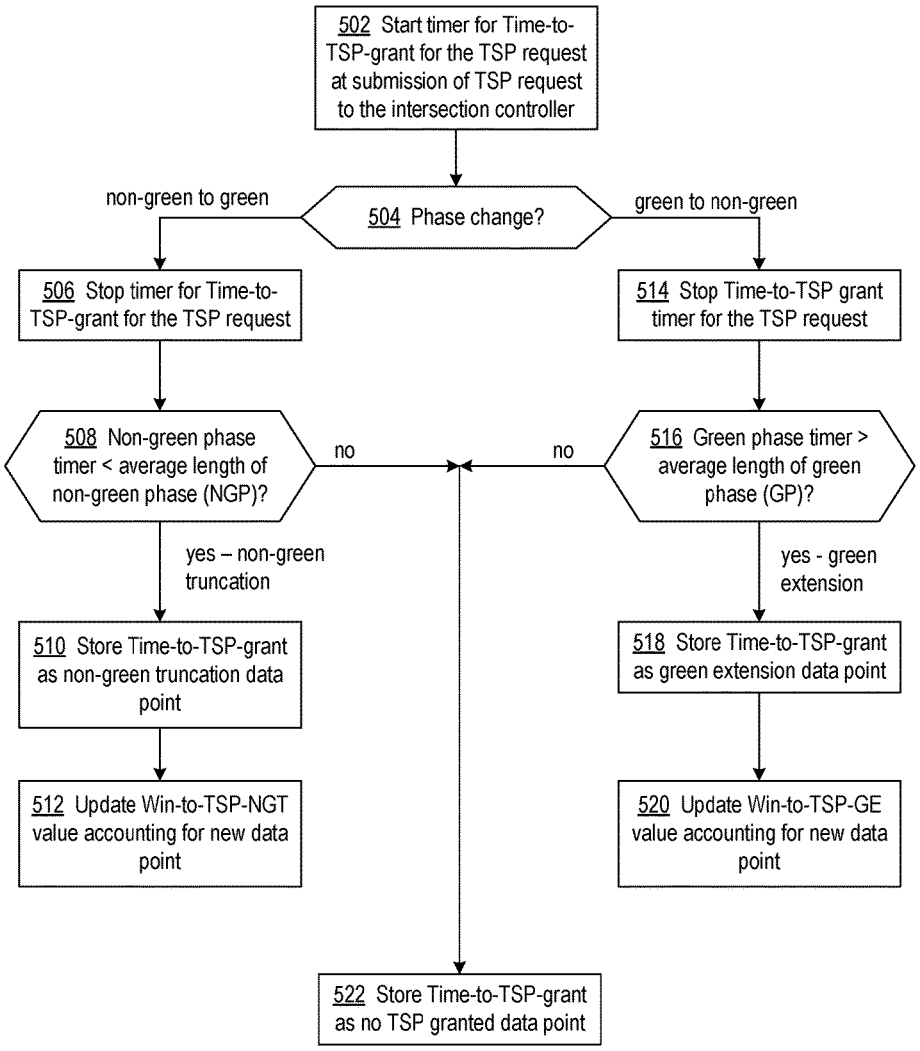
FIG. 12 shows a process of timing the duration between when a TSP request is submitted to the intersection controller and the time the TSP is granted.

FIG. 12 shows a process of timing the duration between when a TSP request is submitted to the intersection controller and the time the TSP is granted; determining whether non-green truncation, green extension, or no is TSP granted; and updating the green extension window and non-green truncation window in which TPS requests can be made and expected to be granted.

At block 502, upon submitting a TSP request to the intersection controller, the phase selector starts a Time-to-TSP-grant timer. After submitting the TSP request, the phase selector monitors the traffic signal for a phase change. At decision block 504, the phase selector detects a phase change and determines the type of phase change. For a phase change from non-green to green, the phase selector stops the Time-to-TSP-grant timer at block 506. At decision block 508, the phase selector determines whether or not a non-green truncation occurred as a result of the TSP request by comparing the value of the non-green phase timer (from FIG. 10) to the average length of non-green phases (NGP). If the value of the non-green phase timer is less than NGP, a non-green truncation occurred, and the phase selector at block 510 stores the value of the Time-to-TSP-grant timer in a data set of Time-to-TSP-grant timer values for non-green truncation. The greatest and least values in the data set define the extent of the non-green truncation window. At block 512, a desired time within the non-green truncation window to submit a TSP request to obtain a non-green truncation is computed. The desired time is designated as Win-to-TSP-NGT and can be a cumulative or moving average (mean, median, or mode) of the data set.

For a phase change from green to non-green, the phase selector stops the Time-to-TSP-grant timer at block 514. At decision block 516, the phase selector determines whether or not a green extension occurred as a result of the TSP request by comparing the value of the green phase timer (from FIG. 11) to the average length of green phases (GP). If the value of the green phase timer is greater than GP, a green extension occurred, and the phase selector at block 518 stores the value of the Time-to-TSP-grant timer in a data set of Time-to-TSP-grant timer values for green extension. The greatest and least values in the data set define the extent of the green extension window. At block 520, a desired time within the green extension window to submit a TSP request to obtain a green extension is computed. The desired time is designated as Win-to-TSP-GE and can be a cumulative or moving average (mean, median, or mode) of the data set.

If neither a non-green truncation nor a green extension resulted from the TSP request, at block 522 the phase selector stores the Time-to-TSP-grant timer value in a data set of timer values for which non-green truncations and green extensions were not granted. Such window is referred to as the "No-TSP treatment-Given-Window."

As previously explained, the ETA computed based on the speed of the vehicle and distance from the intersection may consistently vary from the ATA by some amount. That is, the ETA may consistently be earlier than the ATA or consistently later than the ATA. In an effort to improve the accuracy of the time at which TSP requests are submitted, the phase selector computes an adjusted ETA that accounts for a deviation between an ETA and the ATA.

Figure 13:
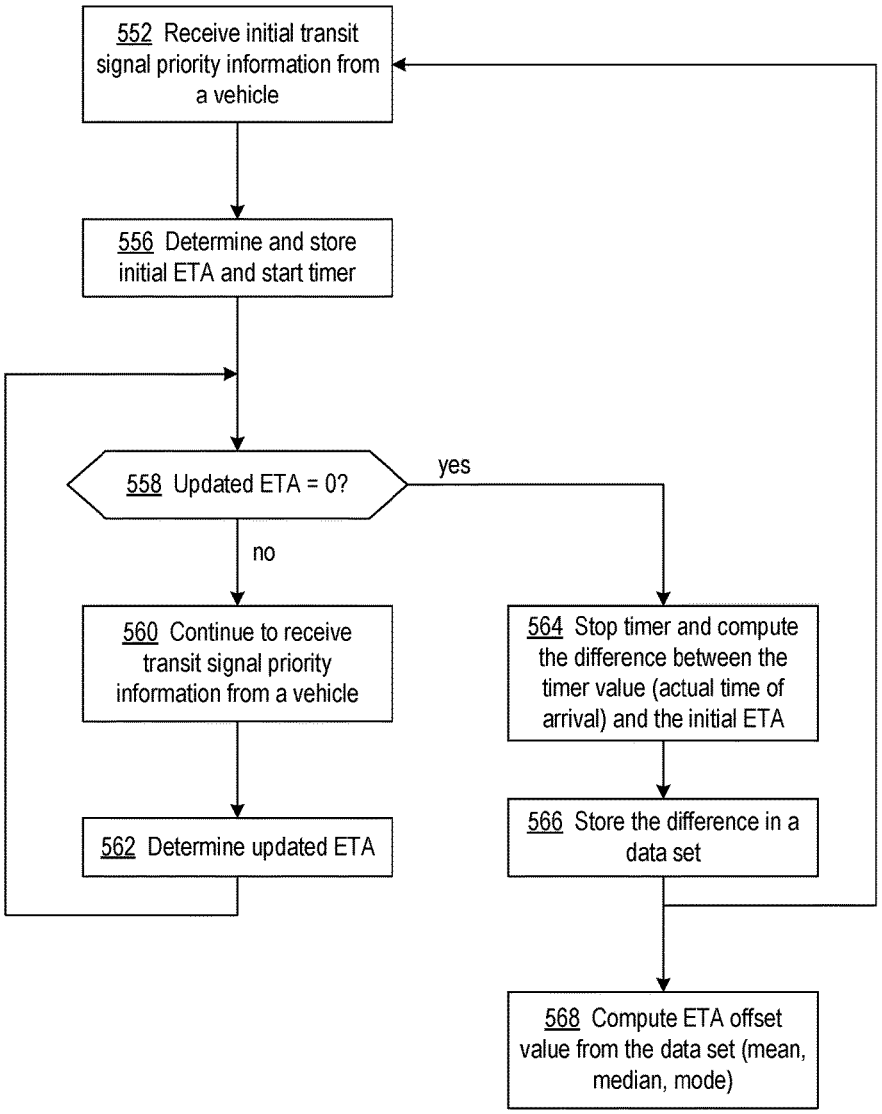
FIG. 13 shows a process by which data are gathered to determine an ETA offset that can be used in computing an adjusted ETA.

FIG. 13 shows a process by which data are gathered to determine an ETA offset that can be used in computing an adjusted ETA. At block 552, the phase selector receives initial TSP information from a vehicle, and at block 556, the phase selector determines and stores an initial ETA, which is the ETA based on first receiving the TSP information from the vehicle, and starts a timer for determining the duration of time from the time at which TSP information is received to the ATA. Depending on the implemented system, the TSP information may include the ETA, or the phase selector can compute the ETA based on speed and location information from the TSP information and the location of the intersection.

The phase selector continues to receive TSP information from the transmitting vehicle at block 560 and determines an updated ETAs at block 562. Once the updated ETA is 0 as determined at decision block 558, which means the vehicle is at the intersection, the phase selector stops the timer at block 564. After stopping the timer, the phase selector determines the difference between the ATA, which is indicated by the timer value and the initial ETA. The difference is stored in a data set at block 566. The process returns to block 552 to gather more data points for computing the ETA offset.

At block 568, the phase selector computes the ETA offset, which is an average of the differences between ETAs and ATAs, using the values in the data set. In one implementation, the ETA offset can be a cumulative or moving average of the values in the data set. The average can be a mean, median, or mode, for example.

FIG. 14 shows a process of determining the time to issue a TSP request. The process is illustrated by way of sections of pseudo code. In section 602, the phase selector receives TSP information, and in section 604 the phase selector computes an adjusted ETA. The adjusted ETA is the ETA of the vehicle (ETAv) plus the ETA offset (ETAd). ETAv and ETAd can be computed as described in FIG. 13, for example.

In section 606, the phase selector determines the amount of time remaining in the current phase and what the next phase will be (green or non-green). If the time remaining until the next green phase is greater than the time remaining until the next non-green phase, as can be determined by the values of the time-to-green timer and time-to-non-green timer from FIGS. 10 and 11, TotalPhases is set to the value of the time-to-non-green timer (time remaining in the current green phase), and the NextPhase is set to NON-GREEN. TotalPhases is used to accumulate the amount of time from the current time at which the TSP information is received through the phase of the adjusted ETA. If the time remaining until the next green phase is not greater than the time remaining until the next non-green phase (time to next green phase is less than or equal to the time to the next non-green phase), TotalPhases is set to the value of the time-to-green timer, and NextPhase is set to GREEN.

The phase selector in section 608 determines what the next phase of the traffic signal will be after the adjusted ETA by totaling the times of the phases beginning with the phase that follows the phase during which the TSP information was received ("current phase"). The average lengths of the green phase (GP) and non-green phase (NGP) are used in accumulating the time in TotalPhases. Once TotalPhases is greater than the adjusted ETA, the value of NextPhase indicates the phase the follows the phase in which the adjusted ETA will occur. The value of TotalPhases is the total amount of time from the time at which the TSP information was received to the beginning of the phase the follows the phase in which the adjusted ETA will occur (see FIG. 15).

In section 610, the phase selector determines whether to issue a TSP request that is expected to result in a non-green truncation or to issue a TSP request that is expected to result in a green extension. The phase selector generally uses the non-green truncation threshold, the green extension threshold, and the adjusted ETA to select between a non-green truncation and a green extension. The phase selector determines the phase relative arrival time (TEphase), which is the time within the phase the vehicle is expected to arrive and is the difference between TotalPhases and the adjusted ETA.

The phase selector uses ratios to evaluate the phase relative arrival time as compared to the non-green truncation threshold and the green extension threshold. If the NextPhase is NON-GREEN, which means the arrival phase is expected to be green, the phase selector determines the time in the green phase of the adjusted ETA to be, LocPhase=TEphase/GP. Note that the in-phase ratio LocPhase having a value 1 indicates the time in the green phase of the adjusted ETA is at the beginning of the green phase, and LocPhase having a value 0 indicates the time in the green phase of the adjusted ETA is at the end of the green phase.

If the vehicle is expected to arrive prior to the non-green truncation threshold, (LocPhase>Non-green truncation threshold), the phase selector determines that truncating the non-green phase preceding the arrival green is desirable and indicates the determination by setting a target TSP time for the making the TSP request, T_ TSP_desired=TotalPhases−GP, which is the end of the preceding non-green phase, and by setting TSPTreatment=Non-green truncation. Otherwise, the vehicle is expected to arrive at or after the non-green truncation threshold, and the phase selector determines that extending the arrival green phase is desirable, indicates the determination by setting the target TSP time for the making the TSP request, T_ TSP_desired=TotalPhases, which is the end of the arrival green phase, and sets TSPTreatment=Green extension.

If the NextPhase is GREEN, which means the arrival phase is expected to be non-green, the phase selector determines the time in the non-green phase of the adjusted ETA to be, LocPhase=TEphase/NGP. Note that the in-phase ratio LocPhase having a value 1 indicates the time in the non-green phase of the adjusted ETA is at the beginning of the green phase, and LocPhase having a value 0 indicates the time in the non-green phase of the adjusted ETA is at the end of the non-green phase.

If the vehicle is expected to arrive prior to the green extension threshold, (LocPhase>green extension threshold), the phase selector determines that extending the green phase preceding the arrival non-green phase is desirable and indicates the determination by setting the target TSP time for the making the TSP request, T_TSP_desired=TotalPhases−NGP, which is the end of the preceding green phase, and by setting TSPTreatment=Green extension. Otherwise, the vehicle is expected to arrive at or after the green extension threshold, and the phase selector determines that truncating the arrival non-green phase is desirable, indicates the determination by setting the target TSP time for the making the TSP request, T_TSP_desired=TotalPhases, which is the end of the arrival non-green phase, and sets TSPTreatment=Non-green truncation.

In section 612, the phase selector determines the time at which the TSP request should be made to the intersection controller by adjusting the T_TSP_desired value, which is the end of a previous green or non-green phase. The time to issue the TSP request is set to the T_TSP_desired value less a non-green truncation offset value or a green extension offset value. The non-green truncation offset value is the midpoint of the non-green truncation window, and the green extension offset value is the midpoint of the green extension window (FIGS. 8 and 9). If TSPTreatment is non-green truncation, Time_to_issue=T_TSP_desired−Win_to_TSP_RT (Win_to_TSP_RT is the midpoint of the non-green truncation window). Otherwise, TSPTreatment is green extension, and Time_to_issue=T_TSP_desired−Win_to_TSP_GT (Win_to_TSP_GE is the midpoint of the non-green truncation window).

If the computed Time_to_issue in block 612 falls within the No-TSP treatment-Given window (FIG. 9, #336), the phase selector can choose to suppress issuing the TSP request, because the intersection controller would likely not process the request and provided the desired green extension or non-green truncation.

Figure 15:
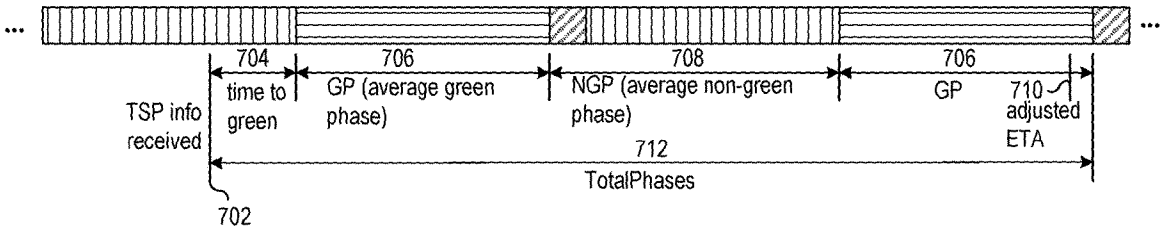
FIG. 15 shows the phases of a traffic signal and the time at which TSP information is first received from a vehicle, the adjusted ETA of the vehicle, the total time of the phases (TotalPhases) through the adjusted ETA, and the NextPhase after the ETA.
Figure 16:
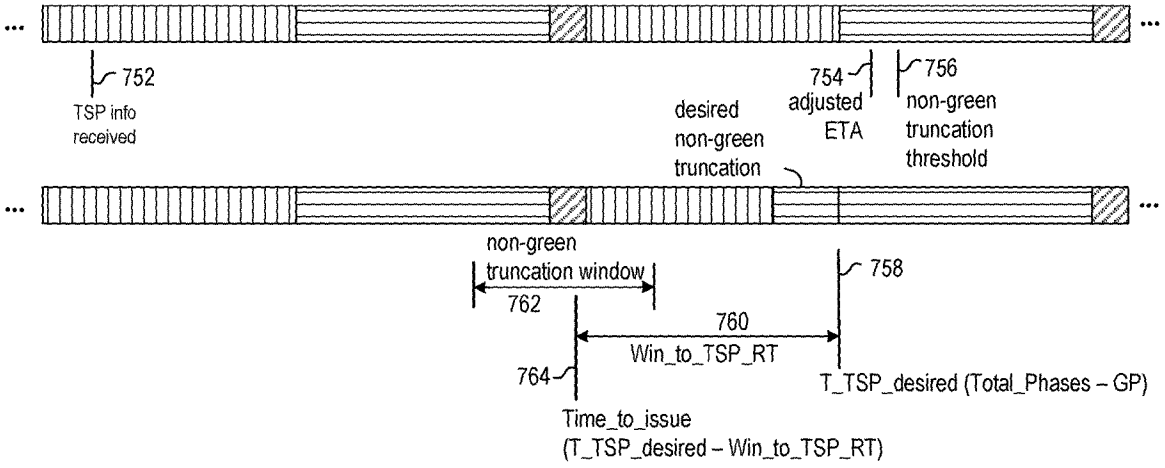
FIG. 16 shows a scenario in which the adjusted ETA of a vehicle is in a green phase, the adjusted ETA is before a non-green truncation threshold, and the Time_to_issue is computed based on desired non-green truncation time and an offset required to obtain the truncation at the desired time.

FIGS. 15 and 16 show examples of phases of a traffic signal relative to the process of determining the time to issue a TSP request as described in FIG. 14. FIG. 15 shows the phases of a traffic signal and the time at which TSP information is first received from a vehicle, the adjusted ETA of the vehicle, the total time of the phases (TotalPhases) through the adjusted ETA, and the NextPhase after the ETA. TSP information is received at the time marked by line 702, which is in a non-green phase. The time remaining in the non-green phase until the next green phase is shown by line 704. The average length of green phases is shown by lines 706, and the average length of non-green phases is shown by line 708. The time of the adjusted ETA is shown by line 710. TotalPhases, which is the amount of time from the time at which TSP information is first received and the beginning of the phase that immediately follows the adjusted ETA, is shown by line 712.

FIG. 16 shows a scenario in which the adjusted ETA of a vehicle is in a green phase, the adjusted ETA is before a non-green truncation threshold, and the Time_to_issue is computed based on desired non-green truncation time and an offset required to obtain the truncation at the desired time.

Line 752 shows the time at which TSP information is received in a non-green phase, and line 754 shows the time of the adjusted ETA. The adjusted ETA precedes the non-green truncation threshold 756, and the phase selector determines to truncate the previous non-green phase. The time at which TSP is desired determined to be the end of the previous non-green phase (T_TSP_desired=TotalPhases−GP) and is shown as line 758.

The non-green truncation offset (Win_to_TSP_RT) is shown as line 760, and extends from the time at which TSP is desired 758 (T_TSP_desired) to the midpoint of the non-green truncation window, which is shown as line 762. The time at which the TSP request is to be issued is shown as line 764 and is computed as Time_to_issue=T_TSP_desired−Win_to_TSP_RT).

Figure 17:
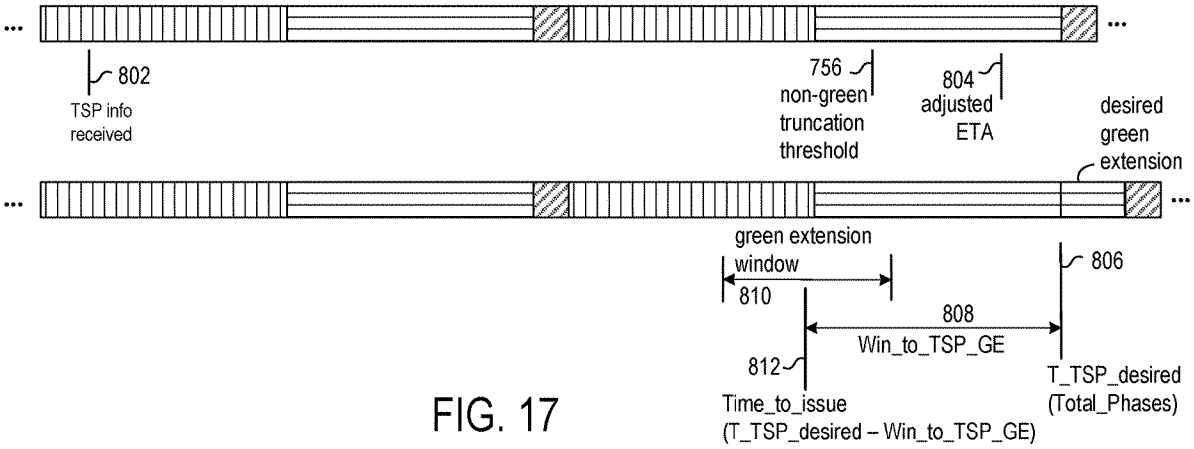
FIG. 17 shows a scenario in which the adjusted ETA of a vehicle is in a green phase, the adjusted ETA is before after the non-green truncation threshold, and the Time_to_issue is computed based on desired green extension time and an offset required to obtain the extension at the desired time.

FIG. 17 shows a scenario in which the adjusted ETA of a vehicle is in a green phase, the adjusted ETA after the non-green truncation threshold, and the Time_to_issue is computed based on desired green extension time and an offset required to obtain the extension at the desired time.

Line 802 shows the time at which TSP information is received in a non-green phase, and line 804 shows the time of the adjusted ETA. The adjusted ETA is after the non-green truncation threshold 756, and the phase selector determines to extend the arrival green phase. The time at which TSP is desired determined to be the end of the arrival green phase (T_TSP_desired=TotalPhases) and is shown as line 806.

The green extension offset (Win_to_TSP_GE) is shown as line 808 and extends from the time at which TSP is desired 806 (T_TSP_desired) to the midpoint of the green extension window, which is shown as line 810. The time at which the TSP request is to be issued is shown as line 812 and is computed as Time_to_issue=T_TSP_desired−Win_to_TSP_RT).

Figure 18:
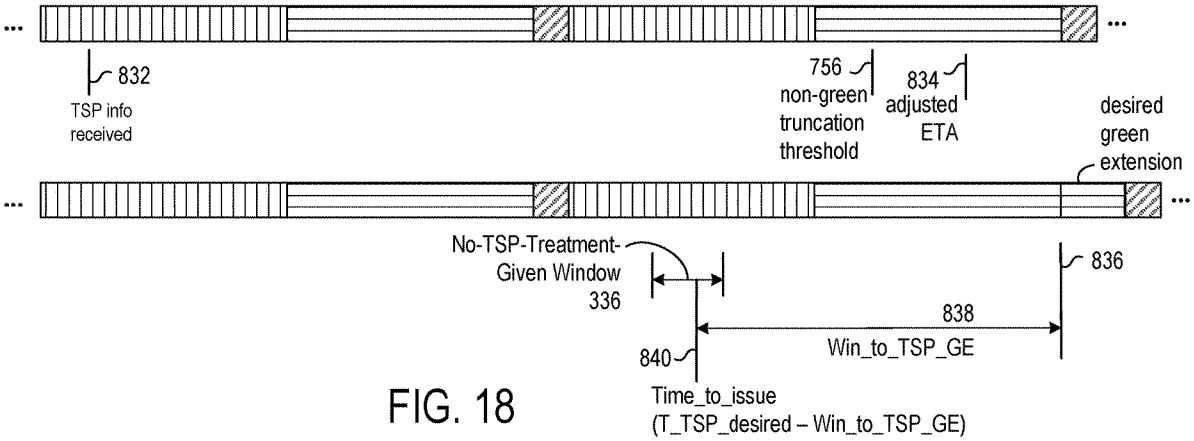
FIG. 18 shows a scenario in which the adjusted ETA of a vehicle is after the non-green truncation threshold in a green phase, and the computed Time_to_issue falls within the No-TSP-Treatment-Given window.

FIG. 18 shows a scenario in which the adjusted ETA of a vehicle is after the non-green truncation threshold in a green phase, and the computed Time_to_issue falls within the No-TSP-Treatment-Given window.

Line 832 shows the time at which TSP information is received in a non-green phase, and line 834 shows the time of the adjusted ETA. The adjusted ETA is after the non-green truncation threshold 756, and the phase selector initially determines to extend the arrival green phase. The time at which TSP is desired determined to be the end of the arrival green phase (T_TSP_desired=TotalPhases) and is shown as line 836.

The green extension offset (Win_to_TSP_GE) is shown as line 838 and extends from the time at which TSP is desired 836 (T_TSP_desired) to the No-TSP-Treatment-Given window 336 (see also FIG. 9). Because the time at which the TSP request is to be issued, which is shown as line 840 and is computed as Time_to_issue=T_TSP_desired−Win_to_TSP_RT), falls within the No-TSP-Treatment-Given window, the phase selector bypasses issuing a TSP request for the green extension.

Various blocks, modules, devices, systems, units, controllers, or engines can be implemented to carry out one or more of the operations and activities described herein and/or shown in the figures. In these contexts, a block, module, device, system, unit, or controller is a circuit that carries out one or more of the disclosed or related operations/activities. For example, in certain of the above-discussed implementations, one or more blocks, modules, devices, systems, units, or controllers are discrete logic circuits or programmable circuits configured and arranged for implementing these operations/activities, as shown in FIG. 2. The programmable circuitry can be one or more computer circuits programmed to execute a set (or sets) of instructions (and/or configuration data). The instructions (and/or configuration data) can be in the form of firmware or software stored in and accessible from a memory (circuit).

Some implementations are directed to a computer program product (e.g., nonvolatile memory device), which includes a machine or computer-readable medium having stored thereon instructions which may be executed by a computer (or other electronic device) to perform these operations/activities.

Though aspects and features may in some cases be described in individual figures, it will be appreciated that features from one figure can be combined with features of another figure even though the combination is not explicitly shown or explicitly described as a combination.

The embodiments are thought to be applicable to a variety of systems for controlling traffic signal phases. Other aspects and embodiments will be apparent to those skilled in the art from consideration of the specification. The embodiments may be implemented as one or more processors configured to execute software, as an application specific integrated circuit (ASIC), or as a logic on a programmable logic device. It is intended that the specification and illustrated embodiments be considered as examples only, with a true scope of the invention being indicated by the following claims.

What is claimed is:

1. A method of submitting transit signal priority (TSP) requests, comprising:

receiving TSP information of a vehicle by a phase selector at a current time;

determining from the TSP information, an estimated time of arrival (ETA) of the vehicle at an intersection having a traffic signal controlled by an intersection controller;

determining a phase of the traffic signal at the ETA, wherein the phase at the ETA is an arrival phase;

determining a phase-relative arrival time of the ETA in the arrival phase;

determining a time to issue the TSP request based on the phase-relative arrival time and one of a non-green truncation threshold and a green extension threshold relative to the arrival phase; and issuing the TSP request by the phase selector to the intersection controller at the determined time.

2. The method of claim 1, wherein:

the determining the phase at the ETA includes determining whether the arrival phase is a green phase or a non-green phase; and the determining the time to issue the TSP request includes determining to truncate a non-green phase that precedes the arrival phase in response to the arrival phase being a green phase and the phase-relative arrival time preceding the non-green truncation threshold.

3. The method of claim 1, wherein:

the determining the phase at the ETA includes determining whether the arrival phase is a green phase or a non-green phase; and the determining the time to issue the TSP request includes determining to extend a green phase that is the arrival phase in response to the arrival phase being a green phase and the phase-relative arrival time succeeding the non-green truncation threshold.

4. The method of claim 1, wherein:

the determining the phase at the ETA includes determining whether the arrival phase is a green phase or a non-green phase; and the determining the time to issue the TSP request includes determining to extend a green phase that precedes the arrival phase in response to the arrival phase being a non-green phase and the phase-relative arrival time preceding the green extension threshold.

5. The method of claim 1, wherein:

the determining the phase at the ETA includes determining whether the arrival phase is a green phase or a non-green phase; and the determining the time to issue the TSP request includes determining to truncate a non-green phase that is the arrival phase in response to the arrival phase being a non-green phase and the phase-relative arrival time succeeding the green extension threshold.

6. The method of claim 1, further comprising:

wherein the determining the phase at the ETA includes determining whether the arrival phase is a green phase or a non-green phase;

wherein the determining the time to issue the TSP request includes determining whether to truncate a non-green phase or extend a green phase based on the phase-relative arrival time relative to the non-green truncation threshold and the green extension threshold in the arrival phase; and determining the non-green truncation threshold and the green extension threshold based on an average of deviations of ETAs of a plurality of vehicles from associated actual times of arrival (ATAs) of the vehicles.

7. The method of claim 1, wherein the determining the ETA includes:

determining an initial ETA based on the TSP information; and adding an ETA offset to the initial ETA, resulting in the ETA, wherein the ETA offset indicates an average of differences between actual times of arrival and initial ETAs of a plurality of vehicles.

8. The method of claim 1, wherein the determining the arrival phase includes:

determining an amount of time remaining in a current phase at a time of the receiving the TSP information; and totaling an amount of time including the time remaining in the current phase and a respective time of each phase between the current phase and a first phase change after the ETA using an average length of green phases and an average length of non-green phases.

9. The method of claim 8, wherein the determining the amount of time remaining in a current phase includes performing, in response to a transition from a non-green phase to a green phase, operations including:

setting a time-to-non-green timer to the average length of green phases plus an average length of green extensions in response to an expected green extension;

setting a time-to-green timer to the average length of green phases plus the average length of non-green phases in response to the expected green extension;

setting the time-to-non-green timer to the average length of green phases in response to an expected non-green truncation;

setting the time-to-green timer to the average length of green phases plus the average length of non-green phases minus an average length of non-green truncations in response to the expected non-green truncation;

setting the time-to-non-green timer to the average length of green phases plus the average length of non-green phases in response to no expected green extension and no expected non-green truncation;

setting the time-to-green timer to the average length of green phases in response to no expected green extension and no expected non-green truncation; and starting the time-to-non-green timer and the time-to-green timer.

10. The method of claim 1, wherein the determining the time to issue the TSP request includes:

determining a target TSP time indicative of a time in a phase at which a non-green truncation extension is targeted; and computing the time to issue the TSP request as a difference between the target TSP time and a non-green truncation offset value.

11. The method of claim 10, further comprising:

determining whether or not the time to issue the TSP request is within a period in which the intersection controller will grant a non-green truncation, based on the non-green truncation threshold; and bypassing issuing TSP request to the intersection controller in response to determining that the time to issue the TSP request is within a period in which the intersection controller will not grant a non-green truncation, based on the non-green truncation threshold.

12. The method of claim 10, further comprising:

starting a time-to-TPS-grant timer in response to the issuing of the TSP request;

stopping the time-to-TPS-grant timer in response to a transition from a non-green phase to a green phase;

determining after stopping the time-to-TPS-grant timer, whether or not the non-green phase was truncated;

storing a value indicated by the time-to-TPS-grant timer in a data set, in response to determining that the non-green phase was truncated; and determining the non-green truncation offset from the data set.

13. The method of claim 1, wherein the determining the time to issue the TSP request includes:

determining a target TSP time indicative of a time in a phase at which a green extension is targeted; and computing the time to issue the TSP request as a difference between the target TSP time and a green extension offset value.

14. The method of claim 13, further comprising:

determining whether or not the time to issue the TSP request is within a period in which the intersection controller will grant a green extension, based on the careen extension threshold; and bypassing issuing TSP request to the intersection controller in response to determining that the time to issue the TSP request is within a period in which the intersection controller will not grant a green extension.

15. The method of claim 13, further comprising:

starting a time-to-TPS-grant timer in response to the issuing of the TSP request;

stopping the time-to-TPS-grant timer in response to a transition from a green phase to a non-green phase;

determining after stopping the time-to-TPS-grant timer, whether or not the green phase was extended;

storing a value indicated by the time-to-TPS-grant timer in a data set, in response to determining that the green phase was extended; and determining the green extension offset from the data set.

16. A traffic signal control system, comprising:

a phase selector configured and arranged to:

receive TSP information of a vehicle at a current time;

determine from the TSP information, an estimated time of arrival (ETA) of the vehicle at an intersection having the traffic signal;

determine a phase of the traffic signal at the ETA, wherein the phase at the ETA is an arrival phase;

determine a phase-relative arrival time of the ETA in the arrival phase;

determine a time to issue a TSP request based on the phase-relative arrival time and one of a non-green truncation threshold and a green extension threshold relative to the arrival phase; and output the TSP request at the determined time; and an intersection controller coupled to the phase selector and to the traffic signal, the intersection controller configured and arranged to adjust a phase of the traffic signal in response to the TSP request.

17. The system of claim 16, wherein:

the phase selector is configured to determine the phase at the ETA by determining whether the arrival phase is a green phase or a non-green phase; and the phase selector is configured to determine the time to issue the TSP request by determining to truncate a non-green phase that precedes the arrival phase in response to the arrival phase being a green phase and the phase-relative arrival time preceding the non-green truncation threshold.

18. The system of claim 16, wherein:

the phase selector is configured to determine the phase at the ETA by determining whether the arrival phase is a green phase or a non-green phase; and the phase selector is configured to determine the time to issue the TSP request by determining to extend a green phase that is the arrival phase in response to the arrival phase being a green phase and the phase-relative arrival time succeeding the non-green truncation threshold.

19. The system of claim 16, wherein:

the phase selector is configured to determine the phase at the ETA by determining whether the arrival phase is a green phase or a non-green phase; and the phase selector is configured to determine the time to issue the TSP request by determining to extend a green phase that precedes the arrival phase in response to the arrival phase being a non-green phase and the phase-relative arrival time preceding the green extension threshold.

20. The system of claim 16, wherein:

the phase selector is configured to determine the phase at the ETA by determining whether the arrival phase is a green phase or a non-green phase; and the phase selector is configured to determine the time to issue the TSP request by determining to truncate a non-green phase that is the arrival phase in response to the arrival phase being a non-green phase and the phase-relative arrival time succeeding the green extension threshold.

21. The system of claim 16, wherein:

the phase selector is configured to determine the phase at the ETA by determining whether the arrival phase is a green phase or a non-green phase;

the phase selector is configured to determine the time to issue the TSP request by determining whether to truncate a non-green phase or extend a green phase based on the phase-relative arrival time relative to the non-green truncation threshold and the green extension threshold in the arrival phase; and the phase selector is further configured to determine the non-green truncation threshold and the green extension threshold based on an average of deviations of ETAs of a plurality of vehicles and associated actual times of arrival (ATAs) of the vehicles.

22. The system of claim 16, wherein the phase selector is configured to determining the ETA by:

determining an initial ETA based on the TSP information; and adding an ETA offset to the initial ETA, resulting in the ETA, wherein the ETA offset indicates an average of differences between actual times of arrival and initial ETAs of a plurality of vehicles.

23. The system of claim 16, wherein the phase selector is configured to determine the arrival phase by:

determining an amount of time remaining in a current phase at a time of receipt of the TSP information; and totaling an amount of time including the time remaining in the current phase and a respective time of each phase between the current phase and a first phase change after the ETA using an average length of green phases and an average length of non-green phases.

24. The system of claim 23, wherein the phase selector is configured to determine the amount of time remaining in a current phase, in response to a transition from a non-green phase to a green phase, by:

setting a time-to-non-green timer to the average length of green phases plus an average length of green extensions in response to an expected green extension;

setting a time-to-green timer to the average length of green phases plus the average length of non-green phases in response to the expected green extension;

setting the time-to-non-green timer to the average length of green phases in response to an expected non-green truncation;

setting the time-to-green timer to the average length of green phases plus the average length of non-green phases minus an average length of non-green truncations in response to the expected non-green truncation;

setting the time-to-non-green timer to the average length of green phases plus the average length of non-green phases in response to no expected green extension and no expected non-green truncation;

setting the time-to-green timer to the average length of green phases in response to no expected green extension and no expected non-green truncation; and starting the time-to-non-green timer and the time-to-green timer.

25. The system of claim 16, wherein the phase selector is configured to determine the time to issue the TSP request by:

determining a target TSP time indicative of a time in a phase at which a non-green truncation extension is targeted; and computing the time to issue the TSP request as a difference between the target TSP time and a non-green truncation offset value.

26. The system of claim 25, wherein the phase selector is further configured to:

determine whether or not the time to issue the TSP request is within a period in which the intersection controller will grant a non-green truncation, based on the non-green truncation threshold; and bypass issuing TSP request to the intersection controller in response to determining that the time to issue the TSP request is within a period in which the intersection controller will not grant a non-green truncation, based on the non-green truncation threshold.

27. The system of claim 25, wherein the phase selector is further configured to:

start a time-to-TPS-grant timer in response to the output of the TSP request;

stop the time-to-TPS-grant timer in response to a transition from a non-green phase to a green phase;

determine after stopping the time-to-TPS-grant timer, whether or not the non-green phase was truncated;

store a value indicated by the time-to-TPS-grant timer in a data set, in response to determining that the non-green phase was truncated; and determine the non-green truncation offset from the data set.

28. The system of claim 16, wherein the phase selector is configured to determine the time to issue the TSP request by:

determining a target TSP time indicative of a time in a phase at which a green extension is targeted; and computing the time to issue the TSP request as a difference between the target TSP time and a green extension offset value.

29. The system of claim 28, wherein the phase selector is further configured to:

determine whether or not the time to issue the TSP request is within a period in which the intersection controller will grant a green extension, based on the green extension threshold; and bypass issuing TSP request to the intersection controller in response to determining that the time to issue the TSP request is within a period in which the intersection controller will not grant a green extension, based on the green extension threshold.

30. The system of claim 28, wherein the phase selector is further configured to:

start a time-to-TPS-grant timer in response to the output of the TSP request;

stop the time-to-TPS-grant timer in response to a transition from a green phase to a non-green phase;

determine after stopping the time-to-TPS-grant timer, whether or not the green phase was extended;

store a value indicated by the time-to-TPS-grant timer in a data set, in response to determining that the green phase was extended; and determine the green extension offset from the data set.

* * * * *